US012285052B2

(12) United States Patent
Yuan et al.

(10) Patent No.: US 12,285,052 B2
(45) Date of Patent: Apr. 29, 2025

(54) ELECTRONIC CIGARETTE

(71) Applicant: SHENZHEN FIRST UNION TECHNOLOGY CO., LTD., Shenzhen (CN)

(72) Inventors: Zhi Yuan, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 435 days.

(21) Appl. No.: 17/764,157

(22) PCT Filed: Sep. 25, 2020

(86) PCT No.: PCT/CN2020/117867

§ 371 (c)(1),
(2) Date: Mar. 25, 2022

(87) PCT Pub. No.: WO2021/057918

PCT Pub. Date: Apr. 1, 2021

(65) Prior Publication Data

US 2022/0369719 A1 Nov. 24, 2022

(30) Foreign Application Priority Data

Sep. 26, 2019 (CN) ..... 201921609864.8

(51) Int. Cl.

| | |
|---|---|
| ***A24F 40/48*** | (2020.01) |
| ***A24F 7/02*** | (2006.01) |
| ***A24F 40/10*** | (2020.01) |
| ***A24F 40/42*** | (2020.01) |
| ***A24F 40/51*** | (2020.01) |

(52) U.S. Cl.

CPC ..... *A24F 40/48* (2020.01); *A24F 7/02* (2013.01); *A24F 40/10* (2020.01); *A24F 40/42* (2020.01); *A24F 40/51* (2020.01)

(58) Field of Classification Search

CPC .. A24F 7/02; A24F 40/10; A24F 40/42; A24F 40/48; A24F 40/51

See application file for complete search history.

(56) References Cited

U.S. PATENT DOCUMENTS

| | | | | |
|---|---|---|---|---|
| 9,877,510 | B2 | 1/2018 | Henry, Jr. | |
| 2013/0340779 | A1 * | 12/2013 | Liu | A24F 40/44 131/329 |
| 2018/0020720 | A1 | 1/2018 | Matischek et al. | |
| 2018/0132536 | A1 * | 5/2018 | Henry, Jr. | A24F 40/50 |
| 2020/0323263 | A1 * | 10/2020 | Dai | A24F 40/40 |

FOREIGN PATENT DOCUMENTS

| | | | | |
|---|---|---|---|---|
| CN | 203692552 | U | 7/2014 | |
| CN | 206324229 | U | 7/2017 | |
| CN | 206978759 | U | 2/2018 | |
| CN | 207202044 | U | 4/2018 | |
| CN | 207821090 | U | 9/2018 | |
| CN | 211211454 | U | 8/2020 | |
| WO | 2015/143749 | A1 | 10/2015 | |
| WO | WO-2019114821 | A1 * | 6/2019 | A24F 40/05 |

* cited by examiner

*Primary Examiner* — Christopher M Rodd
*Assistant Examiner* — Adam Z Baratz
(74) *Attorney, Agent, or Firm* — Cheng-Ju Chiang

(57) ABSTRACT

An electronic cigarette includes a device housing, and an atomizing device disposed in the device housing and an airflow sensor. An airflow path is formed between an air inlet and an aerosol passageway of the device housing so that air outside the electronic cigarette flows into the aerosol passageway through the airflow path. The airflow path includes a first airflow passageway and a second airflow passageway. The first airflow passageway extends along a direction from the air inlet toward the airflow sensor to be spatially communicated with the airflow sensor, and to lead the air outside the electronic cigarette flowing toward the airflow sensor. The second airflow passageway is used to be spatially communicated with the first airflow passageway and the aerosol passageway, respectively, and is used to lead air from the first airflow passageway flowing toward the aerosol passageway along a reverse direction facing away from the airflow sensor.

15 Claims, 5 Drawing Sheets

ELECTRONIC CIGARETTE

CROSS REFERENCE TO RELATED APPLICATIONS

The present invention is a 35 U.S.C. § 371 National Phase conversion of International (PCT) Patent Application No. PCT/CN2020/117867, filed on Sep. 25, 2020, which claims benefit of Chinese Application No. 201921609864.8, filed in Chinese Patent Office on Sep. 26, 2019 and entitled as "Electronic Cigarette", the disclosure of which is incorporated by reference herein. The PCT International Patent Application was filed and published in Chinese.

FIELD OF THE INVENTION

The present invention relates to a technical field of electronic cigarettes, particularly relates to an electronic cigarette.

DESCRIPTION OF BACKGROUND RELATED ART

Electronic cigarettes are an electronic product that is designed to imitate cigarettes, and have a same appearance, smoke, taste and feeling as cigarettes. An electronic cigarette is a product that adopts methods, such as atomization, etc., to atomize tobacco liquid containing nicotine, etc., into aerosols in order for inhaling of users. Since electronic cigarettes have advantages of being convenient for carrying, being used without generating open fire, and being environmentally friendly, electronic cigarettes become favorite from many smoking users.

An existing electronic cigarette usually includes an atomizing component and a battery component. The atomizing component is provided with an atomizing device for atomizing tobacco liquid, a smoke channel for aerosols to be discharged, and a first airflow channel communicated with the smoke channel. The first airflow channel is perpendicular to an axial direction of the electronic cigarette, and is used for external airflows to flow into the electronic cigarette when a user smokes. The battery component is provided with a battery, an airflow sensor and a second airflow channel. The second airflow channel is communicated with the airflow sensor and the smoke channel, and the airflow sensor is used to control the battery to supply power to the atomizing device.

When the user smokes, negative pressure is generated in the electronic cigarette. The airflow sensor receives information of the negative pressure in order to control the battery to supply power to the atomizing device. Heating wires of the atomizing device is electrified to heat tobacco liquid for generating aerosols directly inhaled by the user. However, since the first airflow channel is perpendicular to the axial direction of the electronic cigarette, negative pressure is not easily formed around the airflow sensor when the user smokes. As a result, sensitivity of the electronic cigarette is poor, and the electronic cigarette is inconvenient for the user to use.

BRIEF SUMMARY OF THE INVENTION

In order to solve the aforementioned technical problem, an electronic cigarette having high sensitivity is provided in accordance with a preferred embodiment of the present invention.

An electronic cigarette in accordance with the present invention includes a device housing, an atomizing device disposed in the device housing and an airflow sensor. An air inlet is opened and disposed at the device housing, and an aerosol passageway neighboring and being connected with the atomizing device is formed and disposed in the device housing. An airflow path is formed between the air inlet and the aerosol passageway so that air outside the electronic cigarette flows into the aerosol passageway through the airflow path. The airflow sensor is spatially communicated with the airflow path. The airflow path at least includes a first airflow passageway and a second airflow passageway. The first airflow passageway extends along a direction from the air inlet toward the airflow sensor to be spatially communicated with the airflow sensor, and is used to lead the air outside the electronic cigarette flowing toward the airflow sensor. The second airflow passageway is used to be spatially communicated with the first airflow passageway and the aerosol passageway, respectively, and is used to lead air from the first airflow passageway flowing toward the aerosol passageway along a reverse direction facing away from the airflow sensor.

Preferably, the electronic cigarette further includes an absorbing piece. The absorbing piece is disposed below the atomizing device to absorb leaking tobacco liquid.

Preferably, the electronic cigarette further includes a liquid storing body and an atomizing seat both of which are disposed in the device housing. The aerosol passageway is disposed in the liquid storing body. The first airflow passageway is formed between an outer wall of the atomizing seat and an inner wall of the device housing. The second airflow passageway is opened and disposed in the atomizing seat, and extends along a direction from an end of the atomizing seat facing away from the liquid storing body toward another end of the atomizing seat in order to be spatially communicated with the aerosol passageway in the liquid storing body.

Preferably, the atomizing seat includes a plate section. A column section and a first ring section are formed at a surface of the plate section facing away from the liquid storing body and are formed to extend along a direction facing away from the liquid storing body. The first ring section is disposed to surround the column section. The first airflow passageway is formed between the first ring section and the inner wall of the device housing. The second airflow passageway is formed between the first ring section and the column section.

Preferably, an extension length of the column section from the plate section is larger than an extension length of the first ring section from the plate section.

Preferably, a liquid storage is further disposed in the device housing. The liquid storage is located at an axial line of the aerosol passageway and is spatially communicated with the aerosol passageway in order to store leaking tobacco liquid. The airflow path further includes a third airflow passageway. A first end of the third airflow passageway is spatially communicated with the second airflow passageway. A second end of the third airflow passageway is spatially communicated with the liquid storage. The second airflow passageway is spatially communicated with the aerosol passageway via the third airflow passageway and the liquid storage.

Preferably, the third airflow passageway is disposed to extend along a traverse direction of the electronic cigarette. The aerosol passageway is disposed to extend along a lengthwise direction of the electronic cigarette.

Preferably, the first airflow passageway and the second airflow passageway are both disposed to extend along the lengthwise direction of the electronic cigarette.

Preferably, the first airflow passageway and the second airflow passageway are located at a same side of the airflow sensor. The first airflow passageway and the second airflow passageway are at least partially overlapped along a radial direction of the electronic cigarette.

Preferably, the electronic cigarette further includes a suction nozzle assembly. The suction nozzle assembly is disposed to cover an end of the device housing, and is snapped fit and connected with the liquid storing body. A discharge hole is disposed in the suction nozzle assembly to be spatially communicated with the aerosol passageway.

Preferably, the suction nozzle assembly includes a cover body, a connecting tube and a sealing cover. A connecting groove is disposed at an end of the liquid storing body. A ring-shaped first clasp is disposed at an inner wall face of the connecting groove. The cover body is disposed to cover the end of the device housing. A first end of the connecting tube is inserted and disposed in the cover body, and a second end of the connecting tube is inserted and disposed in the sealing cover. A second clasp snapped fit and engaged with the first clasp is disposed at an outer circumferential face of the connecting tube. An end face and a circumferential face of the sealing cover are respectively resiliently engaged within the connecting groove. The discharge hole penetrates through an end face of the sealing cover in order to be spatially communicated with the aerosol passageway.

The electronic cigarette in accordance with the present invention has the following advantages. The first airflow passageway extends along a direction from the air inlet toward the airflow sensor to be spatially communicated with the airflow sensor, and is used to lead air outside the electronic cigarette flowing toward the airflow sensor. Besides, the second airflow passageway is used to be spatially communicated with the first airflow passageway and the aerosol passageway, respectively, and is used to lead air from the first airflow passageway flowing toward the aerosol passageway along a reverse direction facing away from the airflow sensor. In other words, via cooperation of the first airflow passageway and the second airflow passageway, when inhaling aerosols, air is firstly led to flow toward the airflow sensor through the first airflow passageway, and then is led to flow along the reverse direction facing away from the airflow sensor through the second airflow passageway. As a result, negative pressure in an area where the airflow sensor is located is increased in order to enhance sensitivity of the electronic cigarette.

BRIEF DESCRIPTION OF THE DRAWINGS

One or more embodiments in accordance with the present invention are illustratively exemplified for explanation through figures shown in the corresponding attached drawings. These exemplified descriptions do not constitute any limitation on the embodiments. The elements with the same reference numerals in the attached drawings are denoted as similar elements. Unless otherwise stated, the figures in the attached drawings do not constitute any scale limitation.

DETAILED DESCRIPTION OF THE INVENTION

In order to facilitate best understanding of the present invention, the present invention will be illustrated in more detail below in conjunction with the attached drawings and preferred embodiments.

Figure 1:
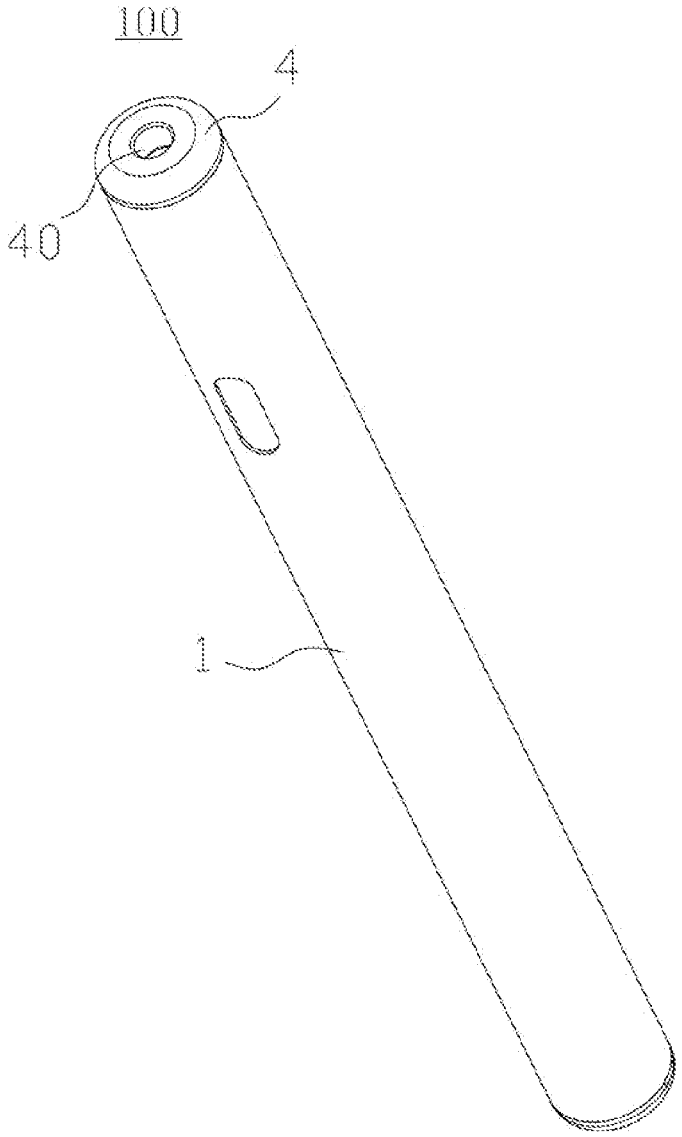
FIG. 1 shows a schematic perspective assembled view of an electronic cigarette in accordance with a preferred embodiment of the present invention.
Figure 2:
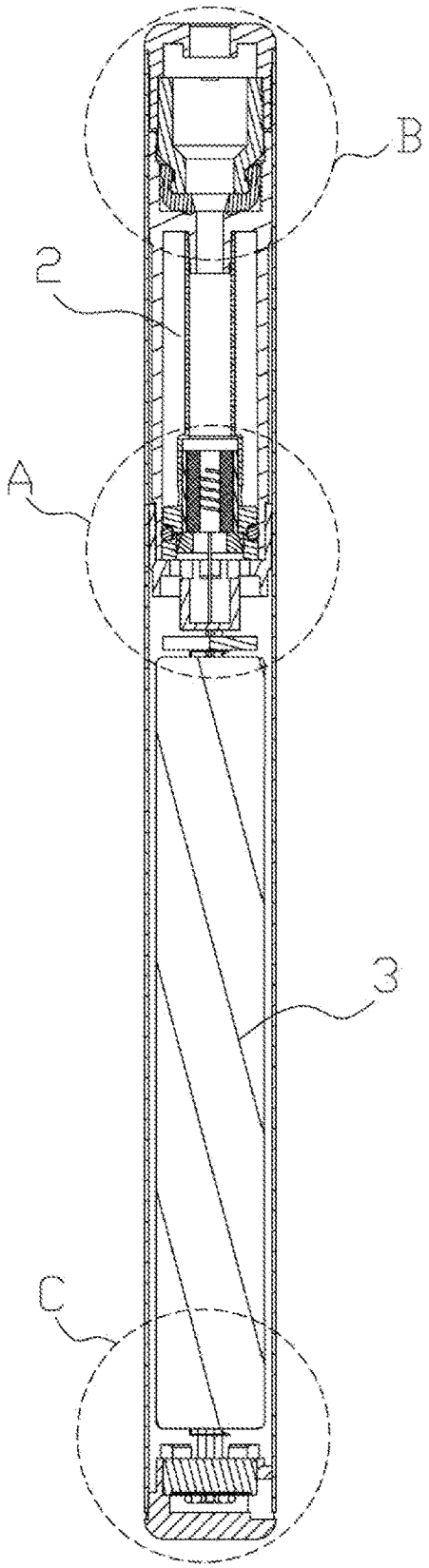
FIG. 2 shows a schematic cross sectional view of the electronic cigarette shown in FIG. 1 in accordance with a preferred embodiment of the present invention.
Figure 3:
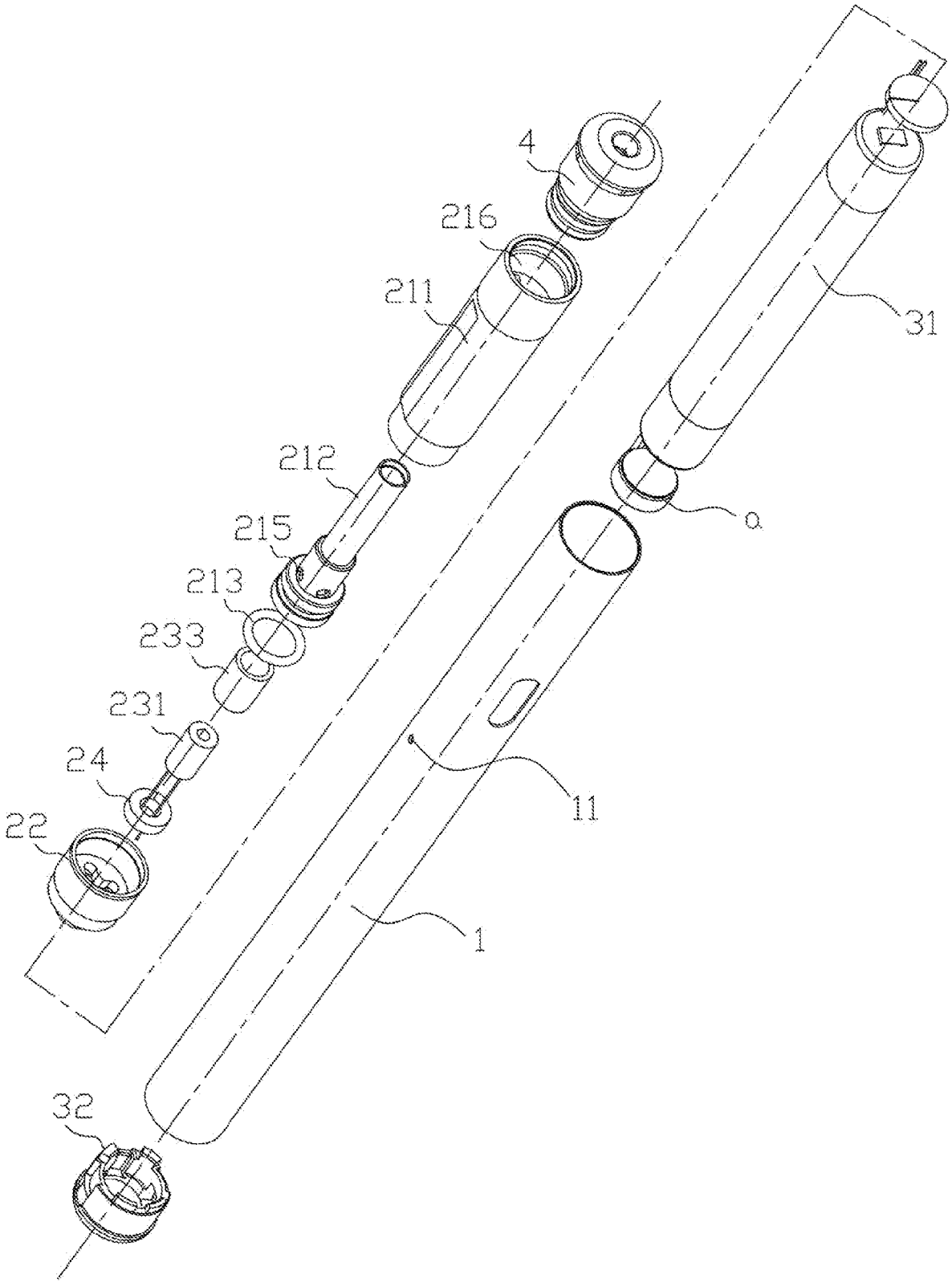
FIG. 3 shows a schematic exploded perspective view of the electronic cigarette shown in FIG. 1 in accordance with a preferred embodiment of the present invention.
Figure 4:
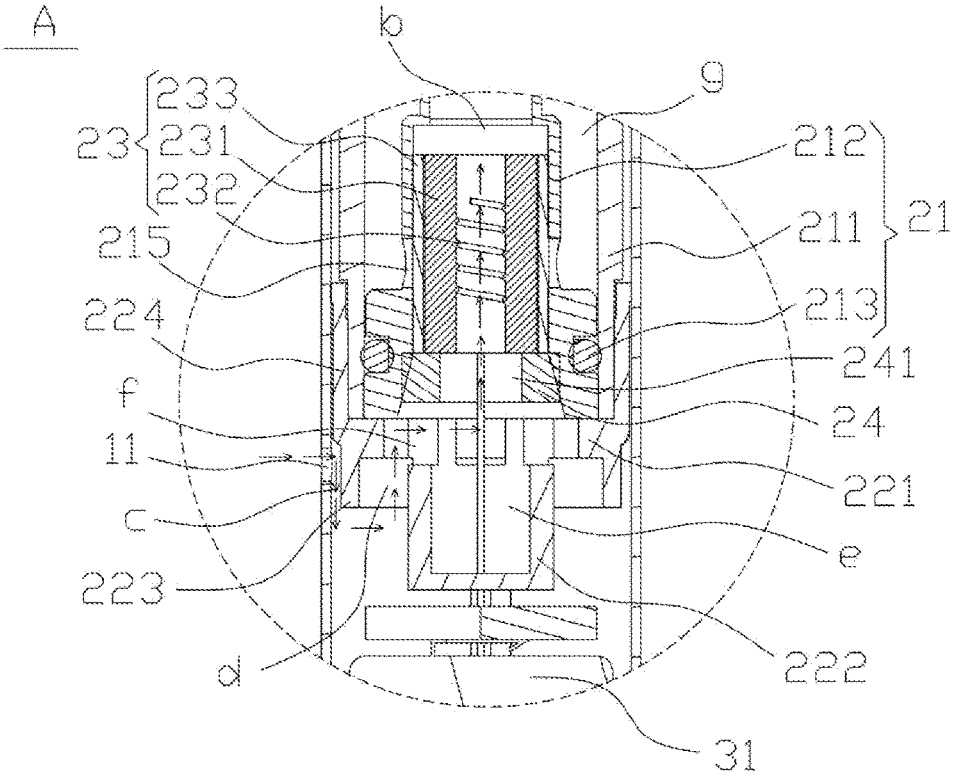
FIG. 4 shows a schematic enlarged cross sectional view of the electronic cigarette shown in a circled area A of FIG. 2.
Figure 5:
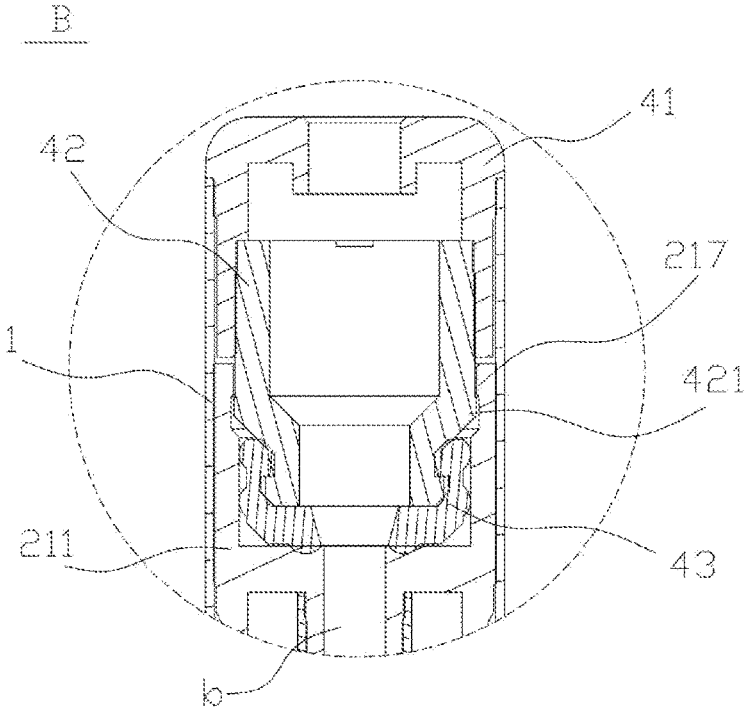
FIG. 5 shows a schematic enlarged cross sectional view of the electronic cigarette shown in a circled area B of FIG. 2.
Figure 6:
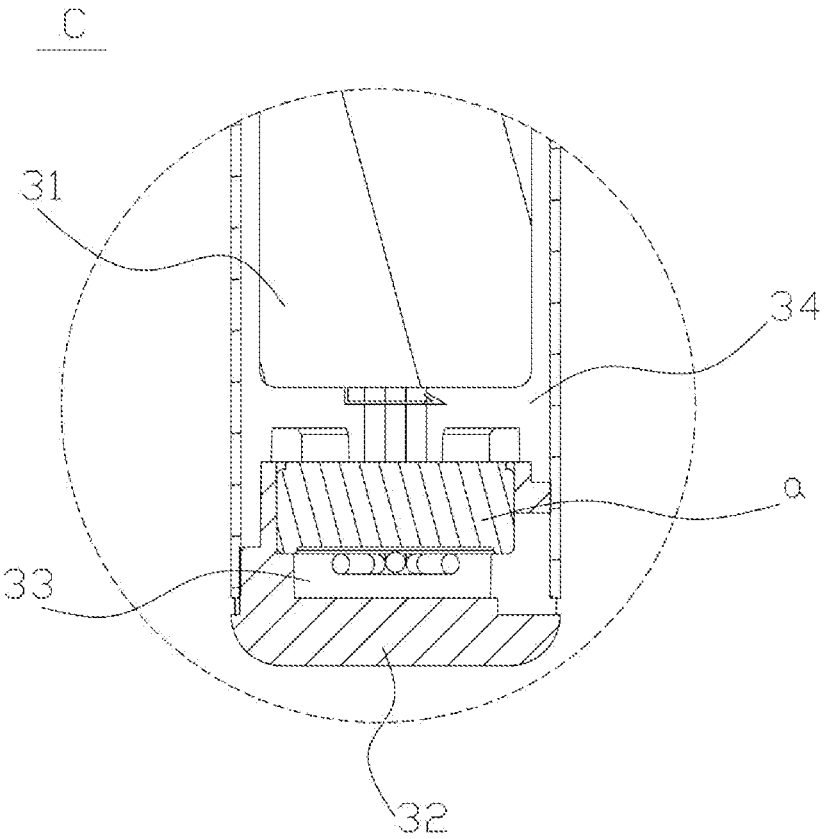
FIG. 6 shows a schematic enlarged cross sectional view of the electronic cigarette shown in a circled area C of FIG. 2.

Referring to FIGS. 1 and 3-4, an electronic cigarette 100 in accordance with a preferred embodiment of the present invention includes a device housing 1, an atomizing assembly 2, a battery assembly 3 and an airflow sensor a. The atomizing assembly 2, the battery assembly 3 and the airflow sensor a are all insertably disposed in the device housing 1. An atomizing device 23 is disposed in the atomizing assembly 2. An air inlet 11 is opened and disposed at the device housing 1, and an aerosol passageway b neighboring and being connected with the atomizing device 23 is formed and disposed in the device housing 1. The aerosol passageway b is used to discharge aerosols formed from atomized tobacco liquid out of the electronic cigarette 100. An airflow path is formed between the air inlet 11 and the aerosol passageway b so that air outside the electronic cigarette 100 flows into the aerosol passageway b through the airflow path. The airflow sensor a is spatially communicated with the airflow path. The airflow sensor a is used to sense inhaling motions of a user in order for controlling the electronic cigarette 100 to atomize tobacco liquid therein.

The airflow path at least includes a first airflow passageway c and a second airflow passageway d. The first airflow passageway c extends along a direction from the air inlet 11 toward the airflow sensor a to be spatially communicated with the airflow sensor a, and is used to lead air outside the electronic cigarette 100 flowing toward the airflow sensor a. When the user inhales for aerosols, airflows from an outside of the electronic cigarette 100 entering the first airflow passageway c flow toward the airflow sensor a. The second airflow passageway d is used to be spatially communicated with the first airflow passageway c and the aerosol passageway b, respectively, and is used to lead air from the first airflow passageway c flowing toward the aerosol passageway b along a reverse direction facing away from the airflow sensor a.

In a preferred embodiment of the present invention, the first airflow passageway c and the second airflow passageway d are located at a same side of the airflow sensor a. Besides, the first airflow passageway c and the second airflow passageway d are at least partially overlapped along a radial direction of the electronic cigarette 100. A first end of the second airflow passageway d is spatially communicated with the first airflow passageway c and the airflow sensor a, respectively. A second end of the second airflow passageway d is spatially communicated with the aerosol passageway b. When the user inhales for aerosols, airflows from the outside of the electronic cigarette 100 entering the first airflow passageway c firstly flow along a first direction toward the airflow sensor a, and then turn to flow into the second airflow passageway d along a second direction facing away from the airflow sensor a in order to be led to the aerosol passageway b. Since the first end of the second airflow passageway d is spatially communicated with both of the first airflow passageway c and the airflow sensor a, a negative pressure is rapidly urged to be formed around the airflow sensor a in order to trigger the airflow sensor a. Flowing directions of airflows are shown by arrows in FIG. 4.

In a preferred embodiment of the present invention, a liquid storage e is further disposed in the electronic cigarette 100. The liquid storage e is located at an axial line of the aerosol passageway b and is spatially communicated with the aerosol passageway b in order to store leaking tobacco liquid. The airflow path further includes a third airflow passageway f A first end of the third airflow passageway f is spatially communicated with the second airflow passageway d. A second end of the third airflow passageway f is spatially communicated with the liquid storage e. The second airflow passageway d is spatially communicated with the aerosol passageway b via the third airflow passageway f and the liquid storage e. Hence, tobacco liquid leaking from the aerosol passageway b can be gathered in the liquid storage e in order to better avoid tobacco liquid leaking everywhere.

The third airflow passageway f is disposed to extend along a traverse direction of the electronic cigarette 100. The aerosol passageway b is disposed to extend along a lengthwise direction of the electronic cigarette 100. Leaking tobacco liquid is not easy to flow into the second airflow passageway d through the third airflow passageway f, and therefore tobacco liquid is better avoided to be inhaled by the user and the third airflow passageway f is better avoided to be blocked by tobacco liquid. The first airflow passageway c and the second airflow passageway d are both disposed to extend along the lengthwise direction of the electronic cigarette 100. As a result, when the user inhales for aerosols, a larger negative pressure can be formed around the airflow sensor a as possible in order to enhance sensitivity of the airflow sensor a.

Referring to FIG. 2 to FIG. 6, in a preferred embodiment of the present invention, the atomizing assembly 2 includes a liquid storing body 21, an atomizing seat 22, the atomizing device 23 and an absorbing piece 24 all of which are disposed in the device housing 1. A liquid storing cavity g and the aerosol passageway b are disposed in the liquid storing body 21. The atomizing seat 22 is connected with the liquid storing body 21. In a preferred embodiment of the present invention, the electronic cigarette 100 is an integrated structure which cannot be dismantled. The atomizing assembly 2 and the battery assembly 3 are coaxially disposed. Understandably, in some embodiments in accordance with the present invention, the atomizing assembly 2 and the battery assembly 3 are detachably connected. The device housing 1 is divided into a first device housing and a second device housing. The atomizing assembly 2 is sheathed and covered by the first device housing, and the battery assembly 3 is sheathed and covered by the second device housing.

The atomizing device 23 is inserted and disposed in the aerosol passageway b to atomize tobacco liquid stored in the liquid storing cavity g. The absorbing piece 24 is disposed below the atomizing device 23 to absorb leaking tobacco liquid. In more particular, the absorbing piece 24 is located between the atomizing seat 22 and the atomizing device 23. A possibility of tobacco liquid leaking everywhere can be further lowered through disposal of the absorbing piece 24 for absorbing leaking tobacco liquid. Specifically, the liquid storing body 21 includes a liquid storing sheath 211, a vent pipe 212 and a seal ring 213. The vent pipe 212 is inserted and disposed in the liquid storing sheath 211. The liquid storing cavity g is formed between the vent pipe 212 and the liquid storing sheath 211. The aerosol passageway b is formed in the vent pipe 212.

Liquid guiding holes 215 are disposed at a lateral wall of the vent pipe 212. Tobacco liquid in the liquid storing cavity g is guided into the atomizing device 23 through the liquid guiding holes 215. The seal ring 213 is surrounded and disposed around an outer circumferential face of the vent pipe 212, and is engaged with an inner wall face of the liquid storing sheath 211 to enhance sealing function for tobacco liquid. Understandably, the liquid storing body 21 can be formed by one or more liquid storing parts. A structure of the liquid storing body 21 is not limited herein as long as the liquid storing body 21 has a capacity of storing tobacco liquid.

The atomizing seat 22 is connected with an end of the liquid storing body 21, and is used to support the liquid storing body 21. The first airflow passageway c is formed between an outer wall of the atomizing seat 22 and an inner wall of the device housing 1. The second airflow passageway d is disposed at an end of the atomizing seat 22 facing away from the liquid storing body 21. The second airflow passageway d extends in the atomizing seat 22 toward another end of the atomizing seat 22 in order to be spatially communicated with the aerosol passageway b in the liquid storing body 21. Hence, the electronic cigarette 100 in accordance with the present invention has advantages of being a simple structure and convenient for production and manufacture. In particular, the atomizing seat 22 includes a plate section 221. A column section 222 and a first ring section 223 are formed at a surface of the plate section 221 facing toward the battery assembly 3 and are formed to extend along a direction toward a location of the battery assembly 3. The first ring section 223 is disposed to surround the column section 222. The first airflow passageway c is formed between the first ring section 223 and the device housing 1. The second airflow passageway d is formed between the first ring section 223 and the column section 222. The above mentioned structure is not only designed to be convenient for manufacture, but also has an advantage that the first airflow passageway c and the second airflow passageway d are not easy to be blocked. Preferably, an extension length of the column section 222 from the plate section 221 is larger than an extension length of the first ring section 223 from the plate section 221. In other words, a length of the first airflow passageway c and a length of the second airflow passageway d are both less than the extension length of the length of the column section 222. A connection of the first airflow passageway c and the second airflow passageway d is located at an outer circumferential face of an end of the column section 222. As a result, flowing of airflows in the airflow path is much smooth.

The liquid storage e is disposed at the surface of the plate section 221 facing toward the battery assembly 3, and the liquid storage e is disposed to extend into the column section 222. In other words, the leaking tobacco liquid is stored via the column section 222. An exit of the liquid storage e is disposed to face the aerosol passageway b. The liquid storage e and the aerosol passageway b are coaxially disposed. As a result, the possibility of leaking tobacco liquid flowing everywhere can be dramatically lowered. The absorbing piece 24 is disposed at the exit of the liquid storage e. A ventilation hole 241 is disposed in the absorbing piece 24 corresponding to a location of the exit of the liquid storage e. The ventilation hole 241 is spatially communicated with the liquid storage e and the aerosol passageway b, respectively. Hence, the absorbing piece 24 can better absorb leaking tobacco liquid. The third airflow passageway f respectively spatially communicated with the second airflow passageway d and the liquid storage e is disposed at a storage wall of the liquid storage e. A second ring section 224 is formed at a surface of the plate section 221 facing away from the battery assembly 3 and is formed to extend along a direction facing away from the battery assembly 3. The second ring section 224 is connected with the liquid storing body 21.

The atomizing device 23 is inserted and disposed in the liquid storing body 21 to atomize tobacco liquid in the liquid storing cavity g. Specifically, the atomizing device 23 and the absorbing piece 24 are both inserted and disposed in the vent pipe 212. The atomizing device 23 includes a porous ceramic tube 231, a heating wire 232 and a liquid guiding tube 233. An end face of the porous ceramic tube 231 facing toward the battery assembly 3 is engaged with the absorbing piece 24. Hence, tobacco liquid in the porous ceramic tube 231 can be blocked to leak into the battery assembly 3. The heating wire 232 is inserted and disposed in the porous ceramic tube 231. The liquid guiding tube 233 covers and surround around the porous ceramic tube 231 in order to absorb tobacco liquid in the liquid storing cavity g. The liquid guiding tube 233 is made from nonwoven cloth or cotton, etc., and is formed by wrapping. Material of the liquid guiding tube 233 is not specifically limited to the above mentioned material as long as the liquid guiding tube 233 is able to absorb tobacco liquid and supplies the absorbed tobacco liquid to the porous ceramic tube 231. Understandably, in some embodiments in accordance with the present invention, the liquid guiding tube 233 is not required and can be omitted. In other embodiments in accordance with the present invention, an electric heating layer is printed in the porous ceramic tube 231 to replace the heating wire 232. Hence, a structure of the atomizing device 23 is not specifically limited herein as long as the atomizing device 23 can be used to atomize tobacco liquid.

The electronic cigarette 100 further includes a suction nozzle assembly 4. The suction nozzle assembly 4 is disposed to cover an end of the device housing 1, and is snapped fit and connected with the liquid storing body 21. A discharge hole 40 is disposed in the suction nozzle assembly 4 to be spatially communicated with the aerosol passageway b. Since the suction nozzle assembly 4 is snapped fit and connected with the liquid storing body 21, the suction nozzle assembly 4 can be better avoided to drop, and be avoided to be eaten by children accidentally.

The suction nozzle assembly 4 includes a cover body 41, a connecting tube 42 and a sealing cover 43. A connecting groove 216 is disposed at an end face of the liquid storing body 21 facing away from the battery assembly 3. Specifically, the connecting groove 216 is disposed at an end face of the liquid storing sheath 211. A ring-shaped first clasp 217 is disposed at an inner wall face of the connecting groove 216. The cover body 41 is disposed to cover the end of the device housing 1. A first end of the connecting tube 42 is inserted and disposed in the cover body 41, and a second end of the connecting tube 42 is inserted and disposed in the sealing cover 43. A second clasp 421 snapped fit and engaged with the first clasp 217 is disposed at an outer circumferential face of the connecting tube 42. An end face and a circumferential face of the sealing cover 43 are respectively resiliently engaged within the connecting groove 216. The discharge hole 40 penetrates through an end face of the sealing cover 43 in order to be spatially communicated with the aerosol passageway b. As a result, connection of the suction nozzle assembly 4 is reliable, and tobacco liquid is better avoided to leak into an oral cavity of the user.

The battery assembly 3 and the atomizing assembly 2 are electrically connected with each other so that the battery assembly 3 is used to supply power to the atomizing assembly 2. The battery assembly 3 includes a battery 31, a fixing seat 32 and the airflow sensor a. The battery 31 is inserted and disposed in the device housing 1, and is electrically connected with the airflow sensor a. The airflow sensor a is inserted and disposed in the fixing seat 32, and is electrically connected with the atomizing assembly 2. An air cavity 33 is formed between the airflow sensor a and the fixing seat 32, and is spatially communicated with an outer surface of the electronic cigarette 100. A negative pressure cavity 34 is formed between the airflow sensor a and the device housing 1, and is spatially communicated with the second airflow passageway d. Understandably, the fixing seat 32 is used to seal another end of the device housing 1. When the user smokes, air inside the negative pressure cavity 34 flows toward the second airflow passageway d to form negative pressure in order for triggering the airflow sensor a. The air cavity 33 and the negative pressure cavity 34 are isolated from each other so that air in the air cavity 33 is blocked from flowing into the negative pressure cavity 34. As a result, sensitivity of the electronic cigarette can be enhanced.

To sum up, the first airflow passageway c extends along a direction from the air inlet 11 toward the airflow sensor a to be spatially communicated with the airflow sensor a, and is used to lead air outside the electronic cigarette 100 flowing toward the airflow sensor a. Besides, the second airflow passageway d is used to be spatially communicated with the first airflow passageway c and the aerosol passageway b, respectively, and is used to lead air from the first airflow passageway c flowing toward the aerosol passageway b along the reverse direction facing away from the airflow sensor a. In other words, via cooperation of the first airflow passageway c and the second airflow passageway d, when inhaling aerosols, air is firstly led to flow toward the airflow sensor a, and then is led to flow along the reverse direction facing away from the airflow sensor a through the second airflow passageway d. As a result, negative pressure in an area where the airflow sensor a is located is increased in order to enhance sensitivity of the electronic cigarette 100.

It should be required to explain that the above specification and its appended drawings in accordance with the present invention are provided to illustrate a preferred embodiment of the present invention, but not to limit the present invention by the preferred embodiment illustrated in the above specification. Furthermore, for the ordinary skilled in the art, they can improve and modify based on the above illustrations of the above specification. Besides, these improvements and modifications or substitutions should be covered by the protected scope of the appended claims provided in accordance with the present invention.

What is claimed is:

1. An electronic cigarette, comprising:

a device housing;

an atomizing device disposed in the device housing;

a battery assembly disposed in the device housing next to the atomizing device; and an airflow sensor disposed at a side of the battery assembly opposite to the atomizing device:

wherein an air inlet is opened and disposed at the device housing, and an aerosol passageway being spatially communicated with the atomizing device is formed and disposed in the device housing, an airflow path is formed between the air inlet and the aerosol passageway so that air outside the electronic cigarette flows into the aerosol passageway through the airflow path, the airflow sensor is spatially communicated with the airflow path via the air flowing in the airflow path passing the battery assembly to reach the side of the battery opposite to the atomizing device, the airflow path at least comprises a first airflow passageway and a second airflow passageway, the first airflow passageway extends along a direction from the air inlet toward the airflow sensor to be spatially communicated with the airflow sensor, and is used to lead the air outside the electronic cigarette flowing toward the airflow sensor, the second airflow passageway is used to be spatially communicated with the first airflow passageway and the aerosol passageway, respectively, and is used to lead air from the first airflow passageway flowing toward the aerosol passageway along a reverse direction facing away from the airflow sensor.

2. The electronic cigarette as claimed in claim 1, wherein the electronic cigarette further comprises an absorbing piece, the absorbing piece is disposed below the atomizing device to absorb leaking tobacco liquid.

3. The electronic cigarette as claimed in claim 1, wherein the electronic cigarette further comprises a liquid storing body and an atomizing seat both of which are disposed in the device housing, the aerosol passageway is disposed in the liquid storing body, the first airflow passageway is formed between an outer wall of the atomizing seat and an inner wall of the device housing, the second airflow passageway is opened and disposed in the atomizing seat, and extends along a direction from an end of the atomizing seat facing away from the liquid storing body toward another end of the atomizing seat in order to be spatially communicated with the aerosol passageway in the liquid storing body.

4. The electronic cigarette as claimed in claim 3, wherein the atomizing seat comprises a plate section, a column section and a first ring section are formed at the plate section and are formed to extend along a direction facing away from the liquid storing body, the first ring section is disposed to surround the column section, the first airflow passageway is formed between the first ring section and the inner wall of the device housing, the second airflow passageway is formed between the first ring section and the column section.

5. The electronic cigarette as claimed in claim 4, wherein an extension length of the column section from the plate section is larger than an extension length of the first ring section from the plate section.

6. The electronic cigarette as claimed in claim 1, wherein a liquid storage is further disposed in the device housing, the liquid storage is located at an axial line of the aerosol passageway and is spatially communicated with the aerosol passageway in order to store leaking tobacco liquid.

7. The electronic cigarette as claimed in claim 6, wherein the airflow path further comprises a third airflow passageway, a first end of the third airflow passageway is spatially communicated with the second airflow passageway, a second end of the third airflow passageway is spatially communicated with the liquid storage, the second airflow passageway is spatially communicated with the aerosol passageway via the third airflow passageway and the liquid storage.

8. The electronic cigarette as claimed in claim 7, wherein the third airflow passageway is disposed to extend along a traverse direction of the electronic cigarette, the aerosol passageway is disposed to extend along a lengthwise direction of the electronic cigarette.

9. The electronic cigarette as claimed in claim 1, wherein the first airflow passageway and the second airflow passageway are both disposed to extend along a lengthwise direction of the electronic cigarette.

10. The electronic cigarette as claimed in claim 9, wherein the first airflow passageway and the second airflow passageway are located at a same side of the airflow sensor, the first airflow passageway and the second airflow passageway are at least partially overlapped along a radial direction of the electronic cigarette.

11. The electronic cigarette as claimed in claim 3, wherein the electronic cigarette further comprises a suction nozzle assembly, the suction nozzle assembly is disposed to cover an end of the device housing, and is snapped fit and connected with the liquid storing body, a discharge hole is disposed in the suction nozzle assembly to be spatially communicated with the aerosol passageway.

12. The electronic cigarette as claimed in claim 11, wherein the suction nozzle assembly comprises a cover body, a connecting tube and a sealing cover, a connecting groove is disposed at an end of the liquid storing body, a ring-shaped first clasp is disposed at an inner wall face of the connecting groove, the cover body is disposed to cover the end of the device housing, a first end of the connecting tube is inserted and disposed in the cover body, and a second end of the connecting tube is inserted and disposed in the sealing cover, a second clasp snapped fit and engaged with the first clasp is disposed at an outer circumferential face of the connecting tube, an end face and a circumferential face of the sealing cover are respectively resiliently engaged within the connecting groove, the discharge hole penetrates through an end face of the sealing cover in order to be spatially communicated with the aerosol passageway.

13. The electronic cigarette as claimed in claim 2, wherein a liquid storage is further disposed in the device housing, the liquid storage is located at an axial line of the aerosol passageway and is spatially communicated with the aerosol passageway in order to store leaking tobacco liquid.

14. The electronic cigarette as claimed in claim 13, wherein the airflow path further comprises a third airflow passageway, a first end of the third airflow passageway is spatially communicated with the second airflow passageway, a second end of the third airflow passageway is spatially communicated with the liquid storage, the second airflow passageway is spatially communicated with the aerosol passageway via the third airflow passageway and the liquid storage.

15. The electronic cigarette as claimed in claim 14, wherein the third airflow passageway is disposed to extend along a traverse direction of the electronic cigarette, the aerosol passageway is disposed to extend along a lengthwise direction of the electronic cigarette.

* * * * *